United States Patent [19]

Herbstman et al.

[11] Patent Number: 5,030,249

[45] Date of Patent: Jul. 9, 1991

[54] GASOLINE DETERGENT ADDITIVE

[75] Inventors: Sheldon Herbstman; Thomas E. Hayden; Theodore E. Nalesnik; Nicholas Benfaremo, all of Wappingers Falls, N.Y.

[73] Assignee: Texaco Inc., White Plains, N.Y.

[21] Appl. No.: 590,741

[22] Filed: Oct. 1, 1990

[51] Int. Cl.[5] ..... C10L 1/22

[52] U.S. Cl. ..... 44/347; 44/348

[58] Field of Search ..... 44/347, 348

[56] References Cited

U.S. PATENT DOCUMENTS

| | | | |
|---|---|---|---|
| 4,501,595 | 2/1985 | Sung et al. | 44/347 |
| 4,533,361 | 8/1985 | Sung et al. | 44/347 |
| 4,699,724 | 10/1987 | Nalesnik et al. | 252/51.5 A |
| 4,863,487 | 9/1989 | Meyer et al. | 44/347 |
| 4,919,684 | 4/1990 | Nalesnik et al. | 44/347 |
| 4,919,685 | 4/1990 | Herbstman et al. | 44/347 |

*Primary Examiner*—Jacqueline V. Howard

*Attorney, Agent, or Firm*—Robert A. Kulason; James J. O'Loughlin; Vincent A. Mallare

[57] ABSTRACT

A gasoline composition comprising:

(a) a major portion of a gasoline fuel, and (b) a minor amount, as a gasoline detergent additive, of a Mannich coupled product of bis-polyisobutylene succinimide of an amine, prepared by:

(i) reacting an alkenyl succinimide acid anhydride with an amine to form a bis-succinimide;

(ii) treating the bis-succinimide with nonylphenol ini the presence of an aldehyde to form a Mannich phenol coupled bis-succinimide product; and (iii) recovering the product Mannich phenol coupled bis-succinimide.

5 Claims, No Drawings

GASOLINE DETERGENT ADDITIVE

BACKGROUND OF THE INVENTION

This invention is related to gasoline engine cleaners and detergents, and more particularly to gasoline intake valve deposit (IVD) additives, agents which assist in removing deposits from intake valves and related parts of a gasoline combustion engines.

There have been additives developed which assist in the removal of deposits particularly in the intake valves such as an additive of Oronite Co. of Wilmington, Del., and sold under the name of OGA-472 which is expensive and costly.

Thus, it is an object of the present invention to provide an effective, inexpensive gasoline additive which will substantially assist in the removal of intake valve deposits.

DISCLOSURE STATEMENT

Co-pending U.S. Application No. 07/590742 discloses a diesel fuel detergent additive for keeping the diesel fuel injectors clean and to aid in the removal of deposits in diesel engines.

U.S. Pat. No. 4,699,724 discloses a lubricating oil composition having improved dispersancy and viton seal compatibility. The dispersant being prepared by coupling two monoalkenyl succinimides with an aldehyde and a phenol. The resulting coupled succinimide is then acylated with glycolic acid to form a glycolated Mannich phenol coupled mono-alkenyl succinimide.

U.S Pat. No. 4,713,189 discloses a lubricating oil composition having improved dispersancy and Viton seal compatibility. The dispersnt being prepared by coupling two polyethyleneamines with an aldehyde and a phenol, followed by conversion to a succinimide. The resulting coupled succinimide is then acylated with glycolic acid to form a glycolated Mannich phenol coupled mono-alkenyl succinimide.

SUMMARY OF THE INVENTION

The present invention provides a gasoline composition containing an intake valve deposit additive which assists in the removal of deposits from intake values. The gasoline composition comprises:

(a) a major portion of a gasoline fuel, and (b) a minor amount, as a gasoline detergent additive, or a Mannich coupled product of bis-polyisobutylene succinimide of an amine, prepared by:

(i) reacting an alkenyl succinimide acid anhydride with an amine to form a bis-succinimide;

(ii) treating the bis-succinimide with nonylphenol in the presence of an aldehyde to form a Mannich phenol coupled bis-succinimide product, and (iii) recovering the product Mannich phenol coupled bis-succinimide.

DETAILED DESCRIPTION OF THE INVENTION

The present invention provides a gasoline fuel composition which when used in internal combustion engines assists significantly in the removal of deposits from intake valves of the combustion engine. The gasoline fuel composition comprises:

(a) a major portion of a gasoline fuel, and (b) a minor amount, as a gasoline detergent additive, or a Mannich coupled product of bis-polyisobutylene succinimide of an amine, prepared by:

(i) reacting an alkenyl succinimide acid anhydride with an amine to form a bis-succinimide;

(ii) treating the bis-succinimide with nonylphenol in the presence of an aldehyde to form a Mannich phenol coupled bis-succinimide product, and (iii) recovering the product Mannich phenol coupled bis-succinimide.

In preparing an effective additive for removing intake valve deposits (IVD) from a combustion engine, an alkenyl succinimide acid anhydride (ASAA) is used which contains polyisobutylene (PIB) groups which have a molecular weight ranging from about 100 to about 3000 and is identified as H-50 ASAA, H-300 ASAA, H-1500 ASAA, and the like. The preferred molecular weight being about 1000 to about 1500, and the most preferred being about 1300.

The alkenyl succinimide acid anhydride is reacted with an amine selected from the group consisting of pentaethylene hexamine (PEHA), diethylenetriamine (DETA), triethylenetetramine, (TETA), and tetraethylenepentamine (TEPA).

The amine and ASAA (alkenyl succinimide acid anhydride) which has a polyisobutylene (PIB) radical attached, are reacted at a temperature of about 80° C. to about 120° C. for about 1 to 2 hours to produce a bis-succinimide. The bis-succinimide is than reacted with nonyl phenol.

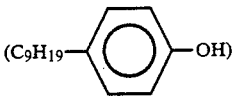

and paraformaldehyde $(CH_2O)_X$ to form the product additive i.e., a Mannich phenol coupled bissuccinimide.

The bis-succinimide is reacted with the nonylphenol and paraformaldehyde at a temperature of about 80° C.–120° C.

The process for preparing the product additive "succinimide" useful in removing deposits from intake valves of gasoline engines, is illustrated below in the Flow Diagram:

As shown in the Flow Diagram, the process includes essentially two steps which are:

(1) reacting an alkenyl succinimide acid anhydride (ASAA) with an amine such as pentaethylene hexamine (PEHA) to provide a bis-succinimide; and (2) reacting the bis-succinimide with nonylphenol and paraformaldehyde to produce the additive product Mannich coupled bis-succinimide.

FLOW DIAGRAM

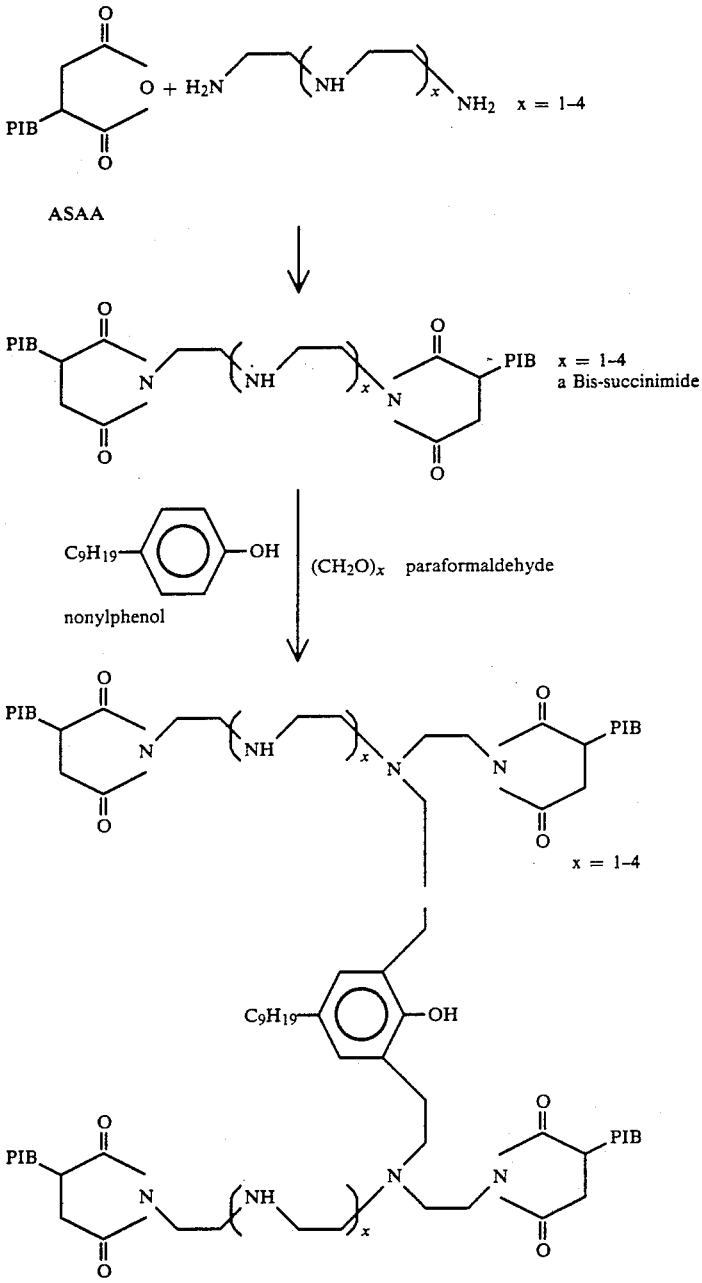

Mannich coupled bis-succinimide

The advantages of the present invention will be more clear when considering the following examples:

EXAMPLE 1

PREPARATION OF PRODUCT BIS-SUCCINIMIDE

Into a 4 neck 12 liter round bottom flask equipped with a mechanical stirrer, was added the 100 E Pale Stock HF (3200 g) and the alkenylsuccinic acid anhydride (4000 g, 1.15 moles). The mixture was stirred under nitrogen and then pentaethylene hexamine (167 g, 0.63 moles) was added and the reaction mixture heated to 20° C. and maintained for 2 hrs. Nonylphenol (70.9 g, 0.315 moles) was then added followed by the formalin solution (37%) (102 g, 1.26 moles) which was added over ten minutes. The addition of these materials result in producing the detergent product Mannich coupled bis-succinimide.

EXAMPLE II

INTAKE VALVE PROBLEM

Observations in one gasoline additive development program revealed an intake valve stickiness problem which seemed to be magnified in several vehicles having four-valve-per-cyclinder engines. This intake valve stickiness occurred after engine shutdown and complete cooldown. The valves remaining open at shutdown due to camshaft orientation would not close properly or else very slowly with the available valve spring force when a cold engine restart was attempted. In turn, this caused a loss of compression in the affected cylinders, usually resulting in a rough or even no engine start. Cold ambient temperatures further intensified the valve stickiness problem.

The valves stickiness problem added another requirement to an intake system deposit screening test. Any new screening test had to include an intake valve stickiness portion that correlated with the four-valve-per-cyclinder test vehicle in which the problem was first observed. Then a screening test, which could discriminate between additives on an intake system deposit (ISD) and intake valve stickiness basis, would prove to be a valuable asset to the entire development process. The equipment of such test is as described below.

TEST EQUIPMENT

The Intake System Deposit/Intake Valve Stickiness test consists of an electrical generator driven by a current technology gasoline engine, similar in many characteristics to modern vehicle engines. The generator set design allows the engine to be easily loaded by using the electrical generator as a dynamometer for the engine. The set operates at a governed speed of 3600 rmp and incorporates a twin cyclinder, overhead camshaft, water cooled engine described below in Table I.

TABLE I

| ENGINE DATA FOR ES6500 HONDA GENERATOR | |
|---|---|
| Type: 4-stroke | Overhead cam, 2 cylinder |
| Cooling System: | liquid cooled |
| Displacement: | 359 cc |
| Bore × Stroke: | 58 × 68 mm |
| Construction: | aluminum head and block, fixed cast iron cylinder liners |
| Compression: | 8.5:1 |
| Maximum Power: | 9.1 Kw/3600 rpm |
| Maximum Torque: | 240 kg-cm |
| Fuel System: | Carburetor |
| Recommended Fuel: | Unleaded gasoline with min 86 (R + M)/2 octane |

Typical engine operating conditions are shown below in Table II.

The gasoline additive development process requires numerous screening tests which should ideally be completed in a relatively short time period, be low cost, but have repeatable results which correlate closely to engine performance.

Gasoline additive screening tests have been developed to produce intake valve deposits. These bench tests, while relatively simple and time efficient, do not incorporate an internal combustion engine in the valve deposit formation process.

The present Mannich base reaction product was used in one Honda generator run at 100 PTB active material as a direct replacement for detergents such as a polyisobutylene amine of ethylene diamine or a reaction product of an aliphatic diamine with maleic anhydride known as Petrox. The results were very good, as good as typically seen with System3, and the deposits were not sticky. System3 is a gasoline additive produced by Texaco Chemical Company of Houston, Tex., which includes a detergent such as the product of Example 1, above, for intake valve deposits. The lower the intake valve deposit weight (IVD), the better the additive. The intake valves in this engine test did not stick for the present product of Example 1.

In the runs (i.e., 2 and 3) of Table II below, detergents were used in each run. That is:

In Run 1—The detergent identified as (A) is a polyisobutylene amine of ethylene diamine, and was used with System3;

In Run 2—The detergent identified as (B) is the present additive, i.e., Mannich reaction product of bis-succinimide, and was used with System3; and Run 3—The detergent identified as (C) is a reaction product of an aliphatic diamine with maleic anhydride, known as Petrox which is produced and sold by Texaco Chemical Company of Houston, Tex. and was used alone.

TABLE II

| | System 3 w/(A)* | System 3 w/(B)** | (C)*** |
|---|---|---|---|
| | Run No. | | |
| | 1 | 2 | 3 |
| CRC Valve Rating | 9.2 | 9.32 | 6.03 |
| IVD Weight | 0.037 gm | 0.042 gm | 0.2685 gm |
| Head Port | 9.35 | 9.41 | 6.49 |
| Head Runner | 9.85 | 9.90 | 7.35 |
| Stickness | No | No | No |

(A)*Polyisobutylene Amine of Ethylene Diamine.
(B)**Mannich Reaction Product of Bis-Succinimide.
(C)***Reaction Product of an Aliphatic Diamine with Maleic Anhydride (Petrox).

Additional additives, such as that of Example I above, may be made using diethylenetriamine (DETA), triethylenetetramine (TETA) or tetraethylenpentamine (TEPA) instead of pentaethylenehexamine (PEHA) on an equimolar basis. Also various phenolic compounds may be used in place of nonylphenol.

We claim:

1. A gasoline fuel composition comprising:

(a) a major portion of a gasoline fuel and (b) a minor amount, as a gasoline detergent additive, of a Mannich coupled product of bis-polyisobutylene succinimide of an amine, prepared by:

(i) reacting an alkenyl succinimide acid anhydride with an amine to form a bis-succinimide;

(ii) treating the bis-succinimide with nonylphenol in the presence of an aldehyde to form a Mannich phenol coupled bis-succinimide product; and (iii) recovering the product Mannich phenol coupled bis-succinimide.

2. The gasoline fuel composition of claim 1, wherein said amine is selected from the group consisting of pentaethylene hexamine, diethylenetriamine, triethylenetetramine and tetraethylene pentamine.

3. The gasoline fuel composition of claim wherein polyisobutenyl groups of said alkenyl succinic acid anhydride has a molecular weight ranging from about 100 to about 3000.

4. The gasoline fuel composition of claim 2, wherein said amine is pentaethylene hexamine.

5. The gasoline fuel composition of claim 2, wherein polyisobutenyl groups of said succinic acid anhydride has a molecular weight of about 1300.

* * * * *